United States Patent [19]

Larson et al.

[11] Patent Number: 4,728,374

[45] Date of Patent: Mar. 1, 1988

[54] SOLUTION HEAT TREATED ENGINE POPPET VALVES

[75] Inventors: Jay M. Larson, Marshall; Lawrence F. Jenkins, Battle Creek, both of Mich.; James E. Belmore, Kearney, Nebr.

[73] Assignee: Eaton Corporation, Cleveland, Ohio

[21] Appl. No.: 903,158

[22] Filed: Sep. 3, 1986

Related U.S. Application Data

[60] Continuation of Ser. No. 766,047, Aug. 15, 1985, abandoned, which is a division of Ser. No. 607,530, May 7, 1984, Pat. No. 4,547,229.

[51] Int. Cl.[4] ..... F01L 3/00

[52] U.S. Cl. ..... 148/320; 148/325; 148/902; 123/188 AA

[58] Field of Search ..... 123/188 AA, 188 A; 148/902, 150, 146, 136, 320, 325

[56] References Cited

U.S. PATENT DOCUMENTS

| | | | |
|---|---|---|---|
| 1,347,542 | 7/1920 | Hilty | 123/188 AA |
| 1,925,116 | 9/1933 | Spence et al. | 148/149 |
| 2,888,373 | 5/1959 | Cherrie et al. | 148/21.54 |
| 3,536,053 | 10/1970 | Vitcha et al. | 123/188 |
| 3,607,461 | 9/1971 | Stanley et al. | 148/38 |
| 3,615,927 | 10/1971 | Paulson | 148/149 |
| 3,636,605 | 10/1969 | Vitcha et al. | 29/156.7 |

*Primary Examiner*—Christopher W. Brody

*Attorney, Agent, or Firm*—D. A. Rowe; A. E. Chrow

[57] ABSTRACT

A new solution heat treated engine poppet valve has been developed which has a microstructure characterized by a large grain size in the head for optimum high temperature creep and fatigue properties and a finer grain size in the stem for good low temperature strength and fatigue properties.

1 Claim, 17 Drawing Figures

SOLUTION HEAT TREATED ENGINE POPPET VALVES

This is a continuation of application Ser. No. 766,047, filed Aug. 15, 1985, now abandoned, which is a division of application Ser. No. 607,530, filed May 7, 1984, now U.S. Pat. No. 4,547,229.

DESCRIPTION

1. Technical Field

The present invention relates generally to engine poppet valves, and more specifically to a new and improved solution heat treatment process which achieves a large grain size in the head for optimum high temperature properties, while maintaining a fine grain size in the stem for optimum low temperature properties.

2. Background Art

The physical properties which are important in engine poppet valve applications include high temperature creep and fatigue strengths in the head which is the portion of the valve that is subjected to the high operating temperatures of the combustion chamber, and good low temperature fatigue and tensile strengths in the stem near the keeper groove.

In making valves from the many austenitic alloys that are available, it is conventional practice to solution heat treat the valves in a batch process. The conventional solution heat treatment process has several disadvantages. When the time and temperature are selected to achieve a microstructure having a large grain size for optimum high temperature properties in the head, there is a sacrifice of low temperature properties in the stem. Conversely, when the time and temperature of heat treatment are selected to achieve good low temperature properties in the stem, it is not possible to obtain the best high temperature properties in the head. Batch-type solution treatment processes tend to cause distortion of the valve stems which makes it necessary to employ a roll straightening operation. Another disadvantage is that it is usually necessary to completely age the valves after solution treatment in order to avoid strain-age cracking associated with roll straightening of the stems. Still other disadvantages of the conventional batch-type solution heat treatment process include the need for an endothermic atmosphere, the processing time that is required, and a general inability to achieve a consistent microstructure from valve-to-valve.

DISCLOSURE OF THE INVENTION

The present invention overcomes the disadvantages of the prior art and provides a new and improved solution heat treatment process which makes it possible to achieve a variable grain microstructure that is consistent with performance requirements of engine poppet valves. The engine poppet valves of the invention are characterized by a large grain size in the head for excellent creep and high temperature fatigue strengths, and by a fine grain size in the stem for good low temperature fatigue and fracture strength properties.

As will be made more apparent from the following disclosure, the improvements provided by the process of this invention can be achieved in both spark-ignited and compression ignition engine valves. Spark-ignited engine valves are subjected to higher head temperatures than compression ignition engine valves and therefore require a solution treated microstructure having a coarser grain size extending beyond the junction of the head and stem. In comparison, compression ignition engine valves typically require only an intermediate to coarse grain size extending a shorter distance into the fillet but not through the junction of the head and stem. The process of the invention makes it possible to solution heat treat spark-ignited engine valves differently from compression ignition engine valves in a manner that produces the microstructure best suited for particular operating environments.

According to one aspect of the invention there is provided a method of solution heat treating engine poppet valves and the like comprising subjecting the heads of the valves to solution heat treatment conditions selected to achieve a desired grain size consistent with good high temperature properties, and maintaining a finer grain size in the stems consistent with good low temperature properties, whereby the resulting microstructure is characterized by a coarse grain size in the head becoming progressively finer through a specific transition zone to a fine grain size in the stem. In preferred embodiments of the invention, the valves are solution treated to achieve a grain size of about ASTM 5 or larger in the head and a grain size of about ASTM 8 or finer in the stems.

According to another aspect of the invention, there is provided a solution heat treated engine poppet valve characterized by a coarse grain size in the valve head become progressively finer through a specific transition zone to a fine grain size in the stem, the grain size in the head being about ASTM 5 or larger and the grain size in the stem being about ASTM 8 or finer.

In the specific examples described hereinafter, the valves are solution heat treated in a radiant heating electric furnace at a temperature in the range of from about 2200°–2400° F. for a period of from about 2–10 minutes. The furnace has a rotating hearth, and the valves are held upright with the combustion faces of the heads extending a selected amount into the furnace chamber below the globars. As the valves are carried through the furnace chamber, the heads are heated at a rate of from about 100°–200° F. per second to achieve rapid solution heat treatment to a predetermined depth, while the stems of the valves are maintained at lower temperature conditions. Alternative heating techniques include induction and fluidized bed heat treating.

The continuous, rapid solution heat treatment process contemplated by this invention provides many important advantages over the conventional batch process in addition to achieving a novel microstructure characterized by a variable grain size. The rapid heat-up of the operation avoids the occurrence of secondary recrystallization and abnormal grain growth, and results in a more consistent grain size at any given location in the valve when compared to conventional solution treated valves. The process of the invention decreases head and stem distortion normally associated with batch solution treatment of valves. In some cases, the valves need only be straightened prior to solution treatment by the new process, and no subsequent straightening is required. Another important advantage is that valves made according to the invention from precipitation strengthened materials can be placed in engines in the as-solution-treated condition and aged in service. This has not been possible with conventional batch solution treated parts because of strain age cracking.

Still another important advantage that is afforded is the ability to solution treat selectively the head portion of a welded two piece valve in which a stem portion has been welded to the head portion. Selective and rapid solution treatment of the head portion avoids heating of the weld zone and resulting metallurgical changes at the weld zone.

A further advantage of this invention is realized with seat welded valves which can exhibit undersirable tensile stresses of the seat unless stress reversed by a separate head treatment that reverses the stresses into the desirable compressive mode. The rapid solution treatment process of the present invention makes it possible to stress reverse and solution treat the faced valve head in a single operation. The simultaneous solution treatment also minimizes the material property degradation associated with the heat affected zone caused by the seat welding operation.

The new continuous process of solution treatment can be carried out more rapidly than a batch process and is amenable to automation. At the same time, the process makes it possible to produce a consistent, selected microstructure from valve-to-valve which is best suited to the intended operating environment. Other advantages are that the new operation does not require the conventionally used endothermic atmosphere because of the extremely short time the valves are at a high temperature. The need for liquid quenching is avoided because the valves are treated as individual parts and can be cooled adequately by an air cooling system.

Further advantages and a fuller understanding of the invention will become apparent from the following detailed description.

BEST CODE FOR CARRYING OUT THE INVENTION

Figure 1:
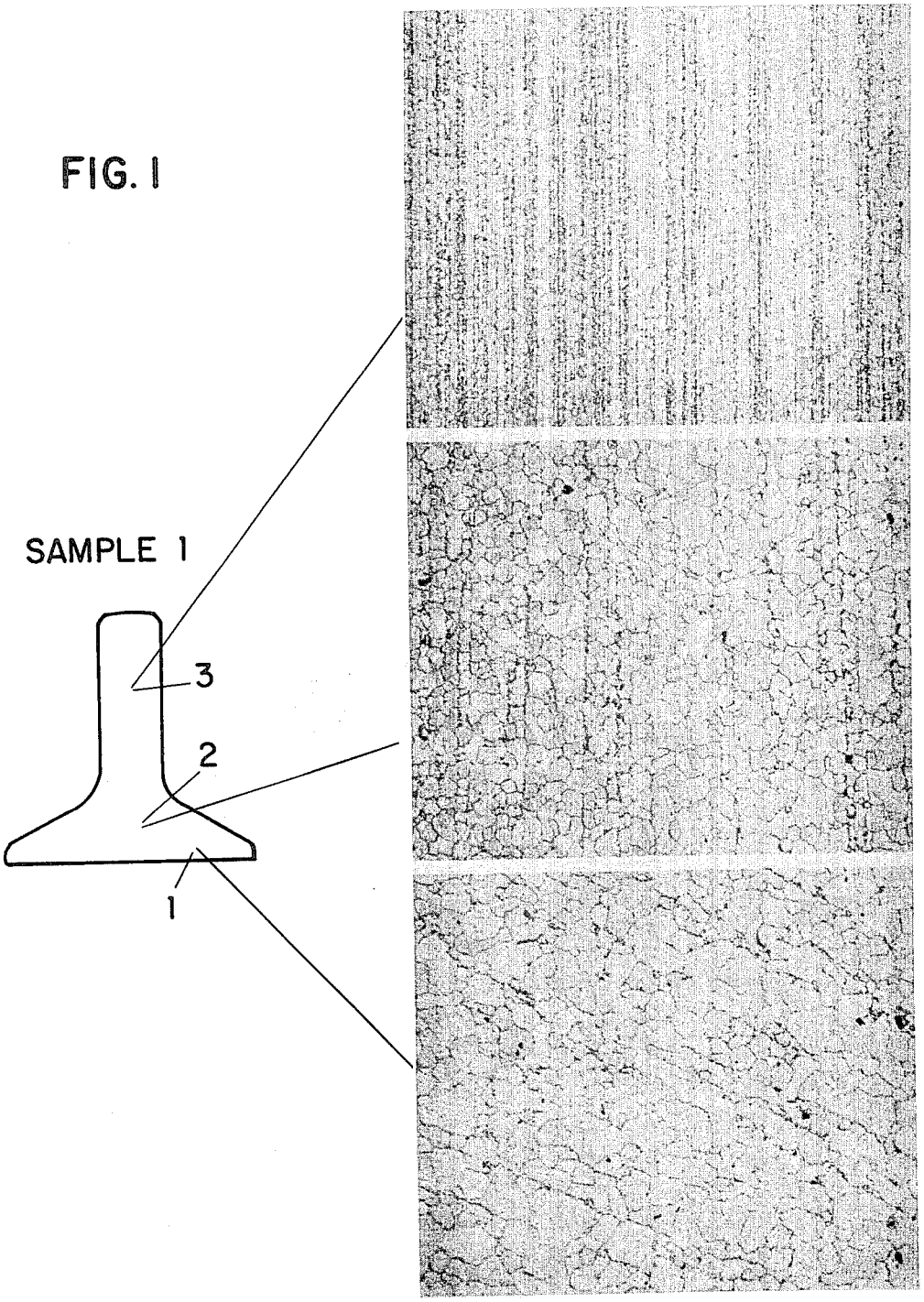
FIGS. 1–14 are photomicrographs showing the microstructures of valves processed according to the present invention.
Figure 2:
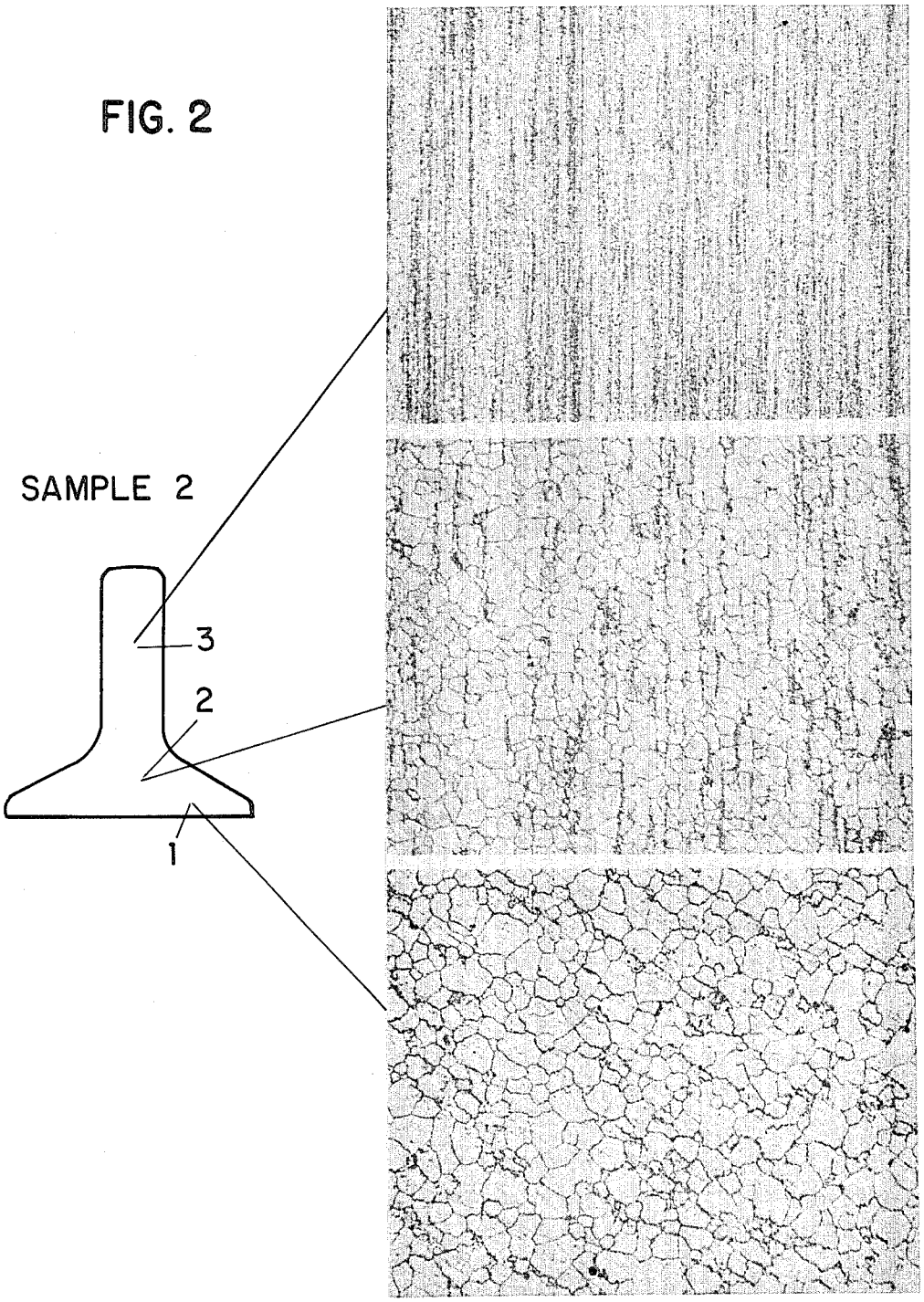
Figure 3:
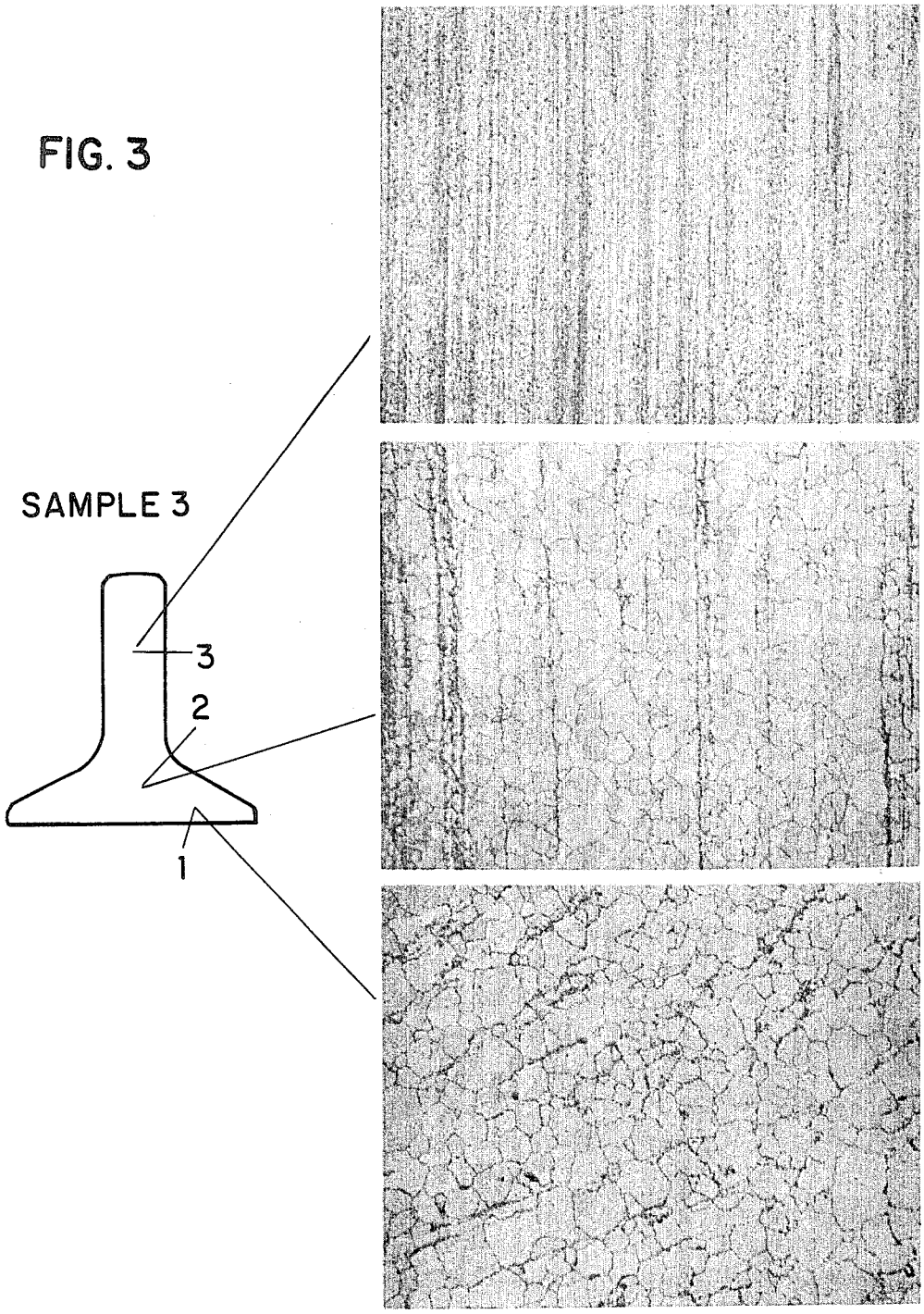
Figure 4:
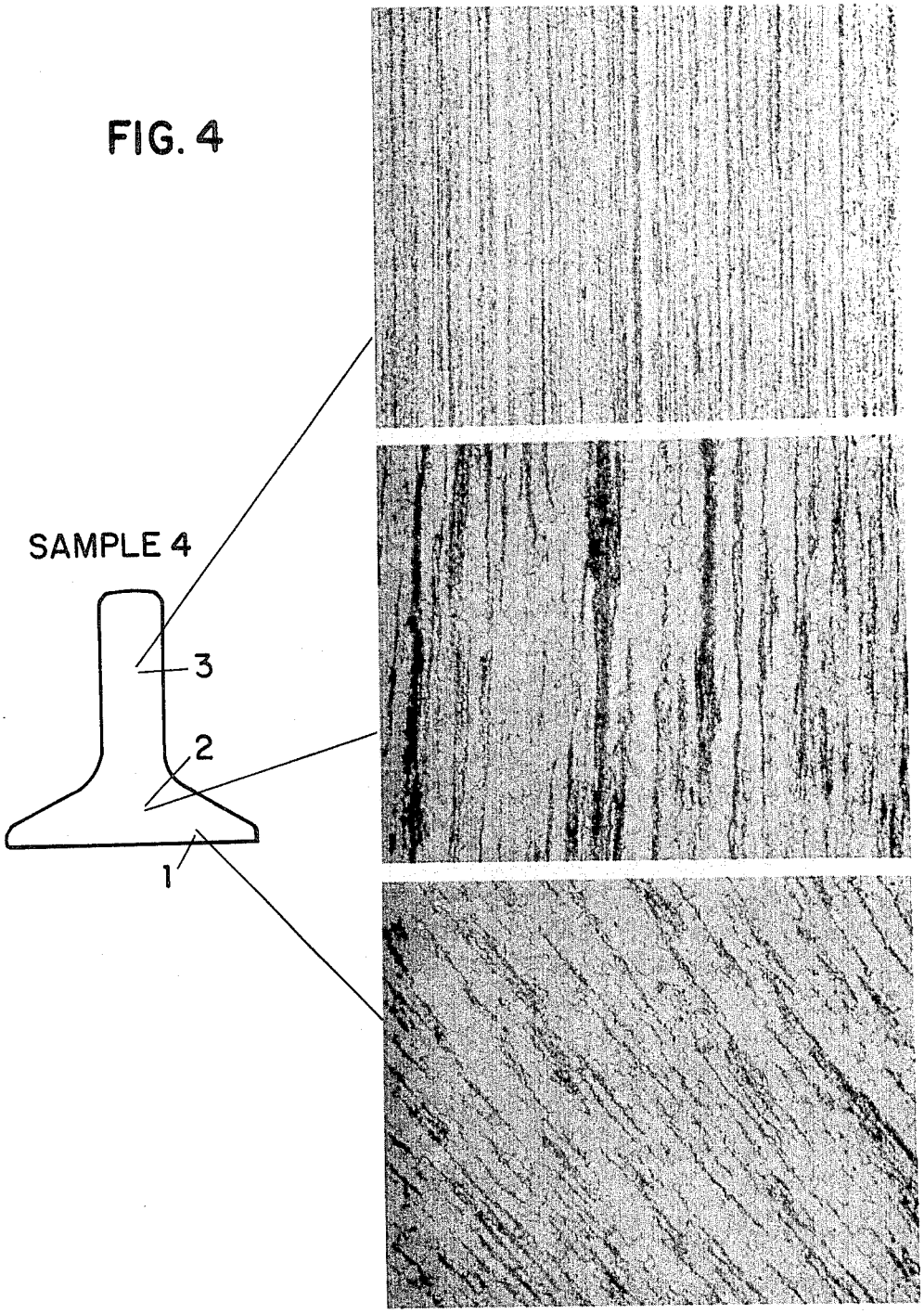
Figure 5:
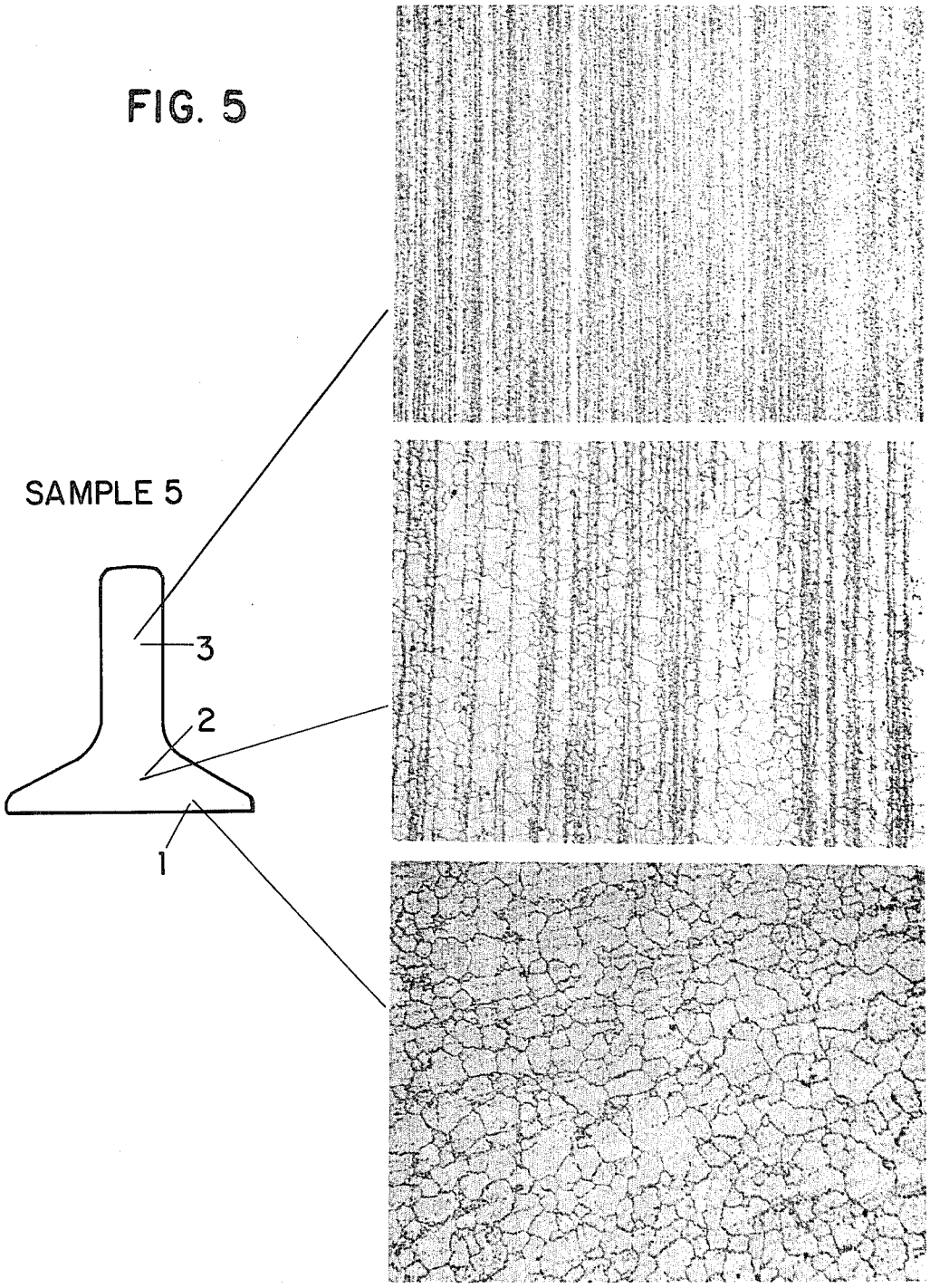
Figure 6:
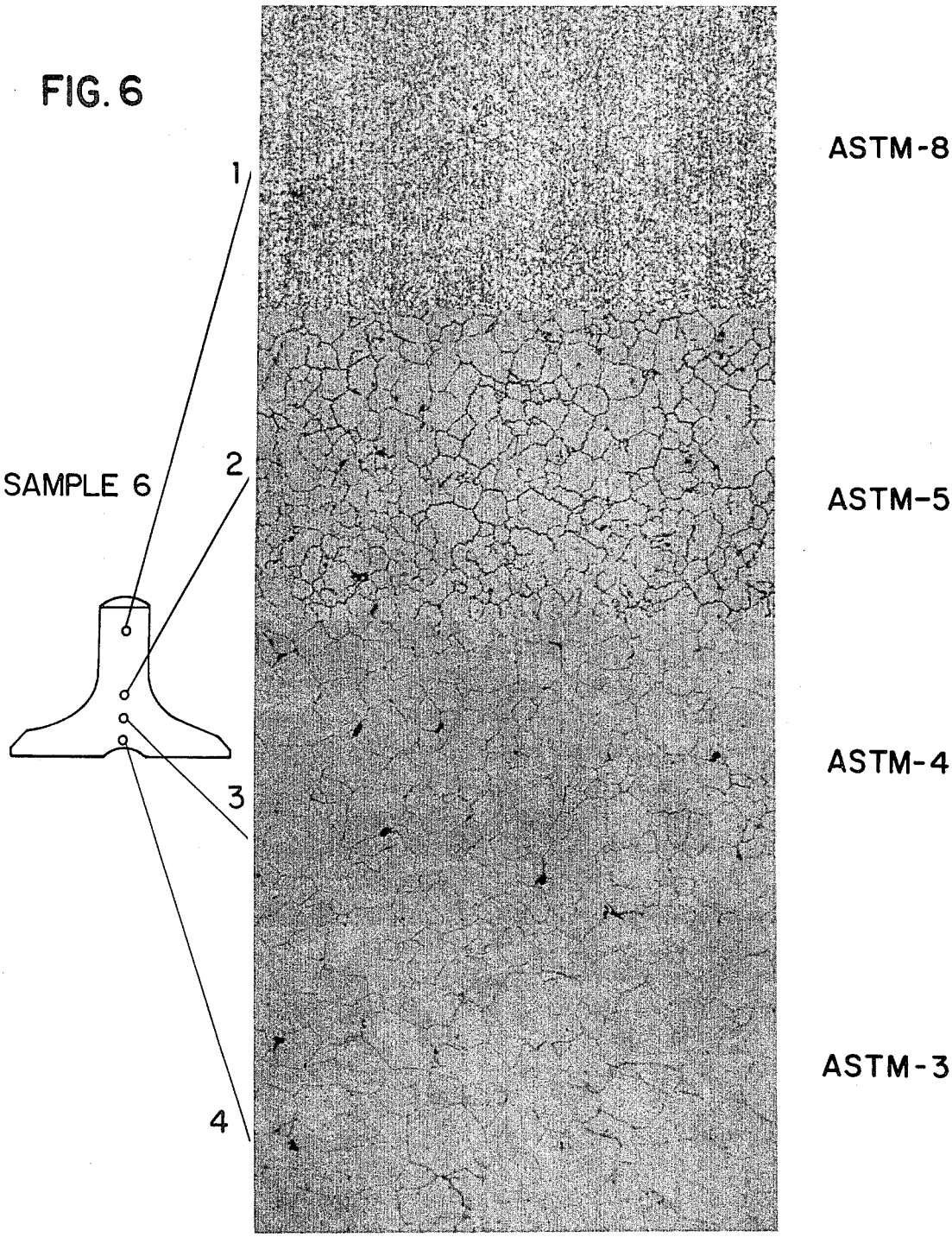
Figure 7:
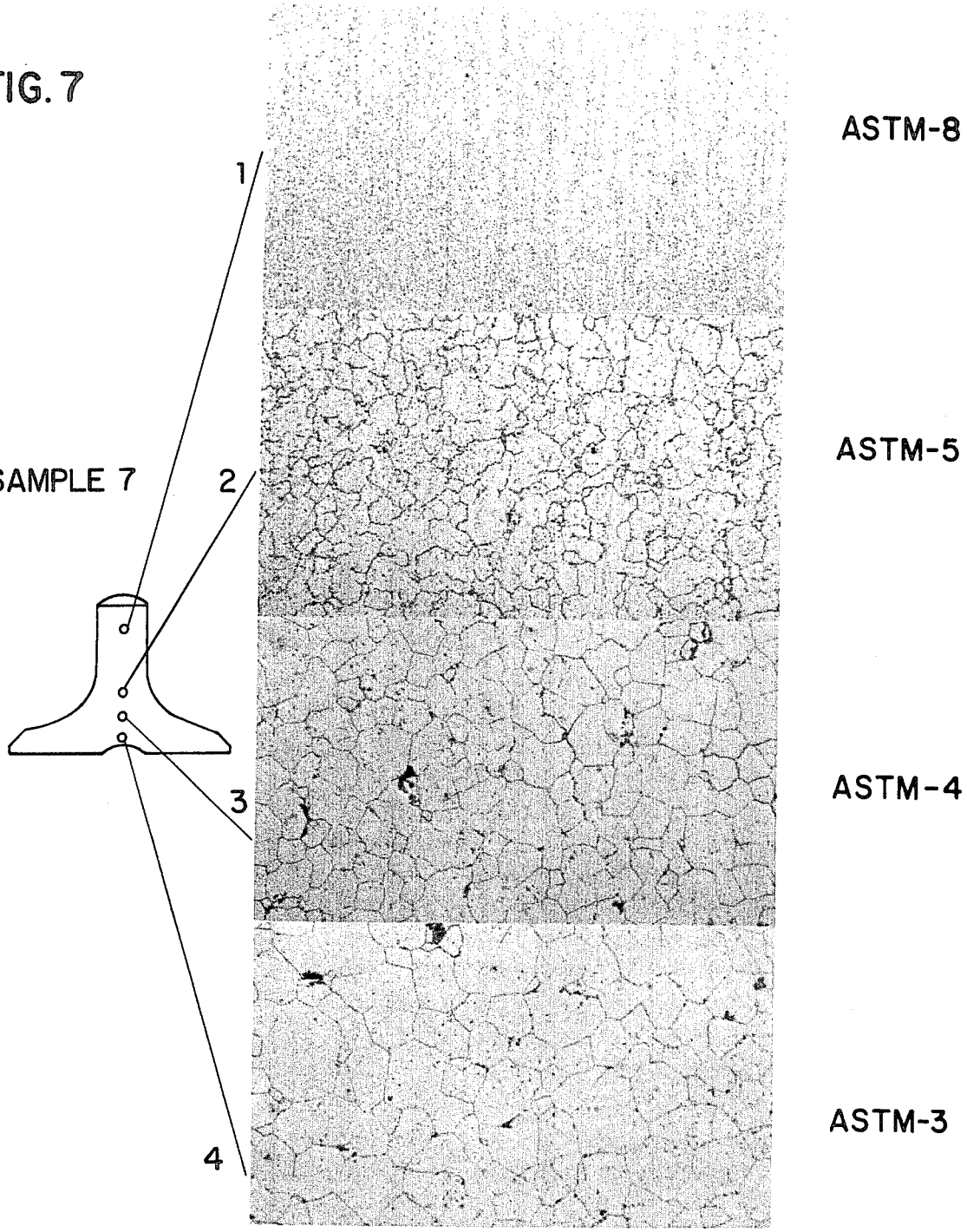
Figure 8:
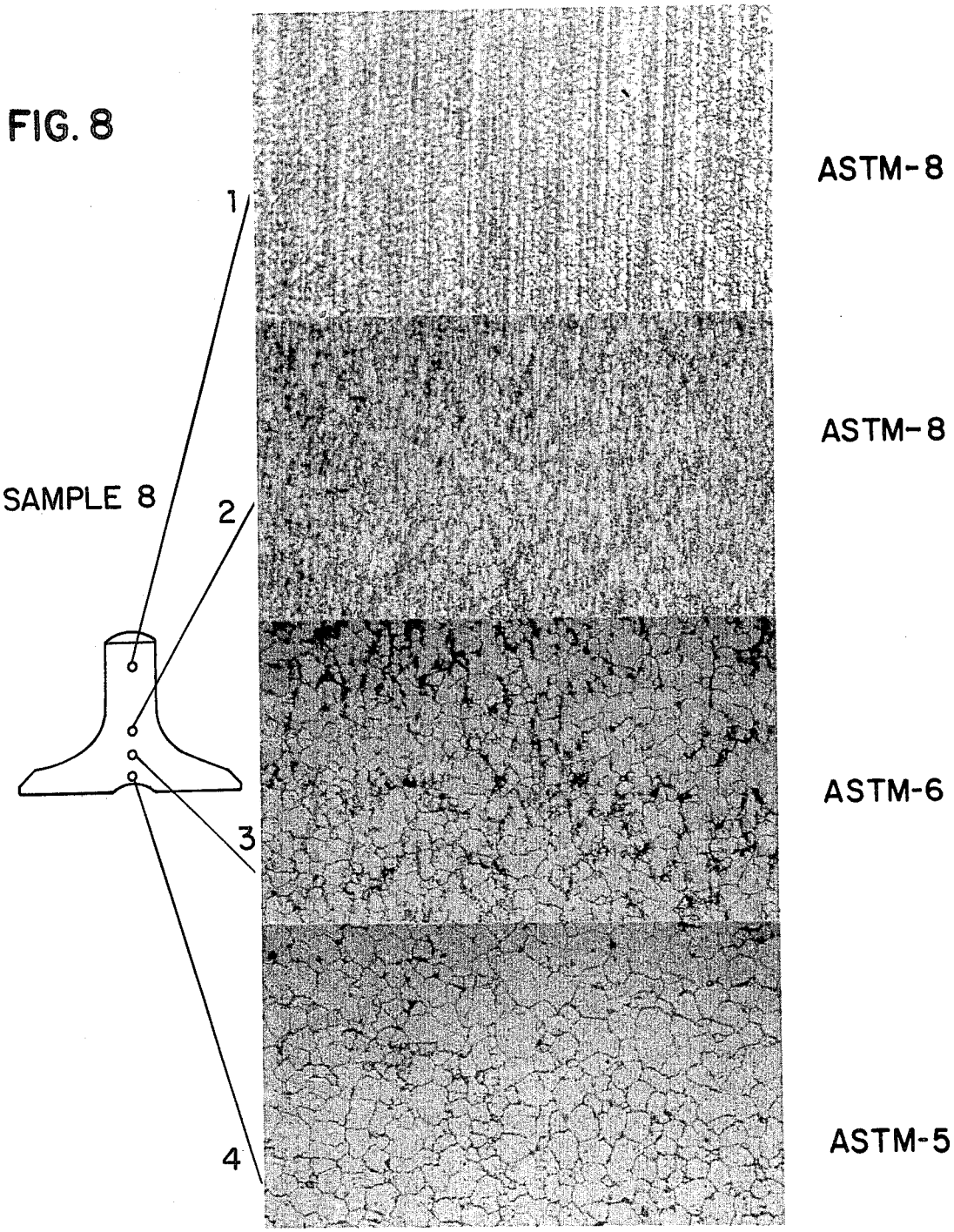
Figure 9:
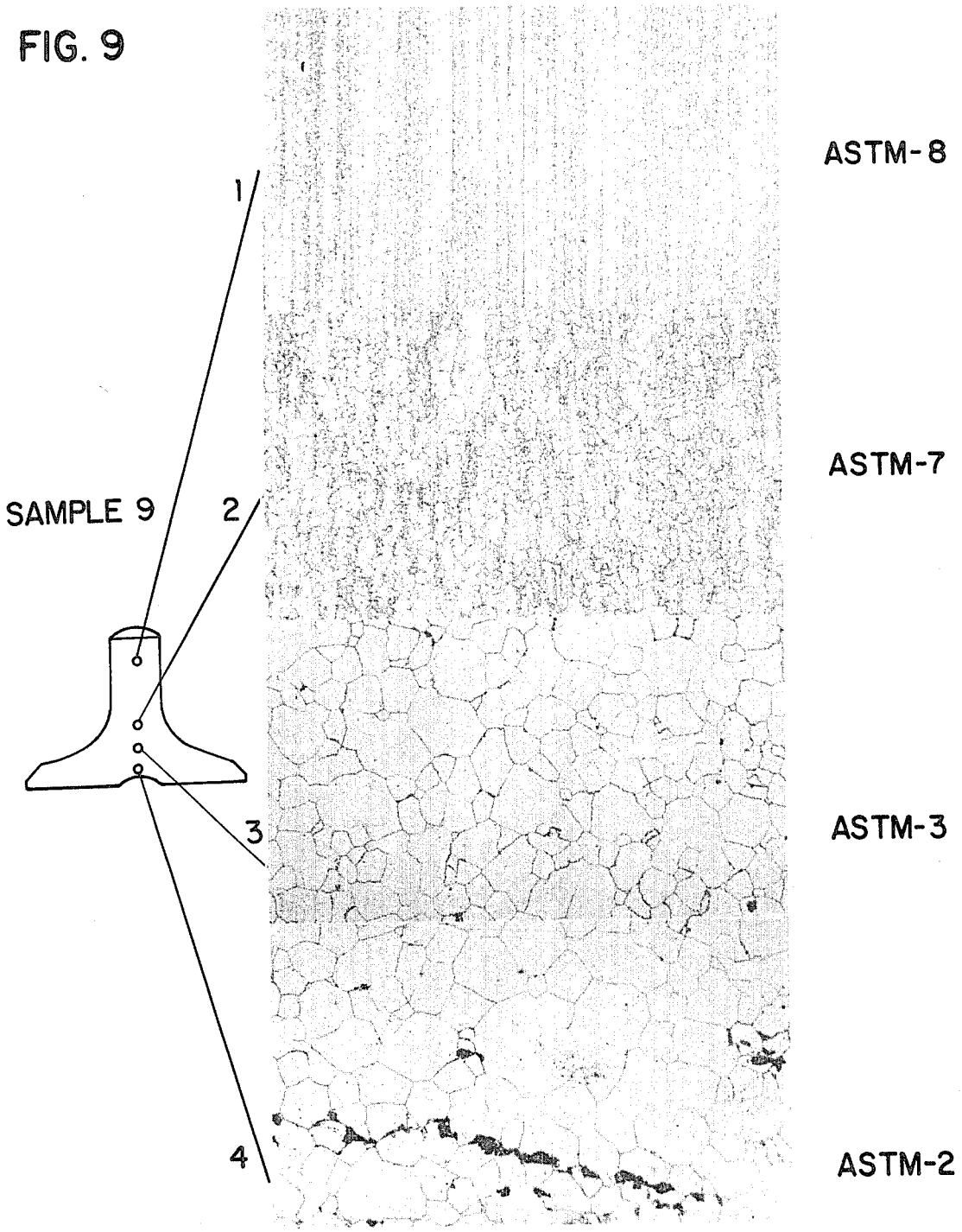
Figure 10:
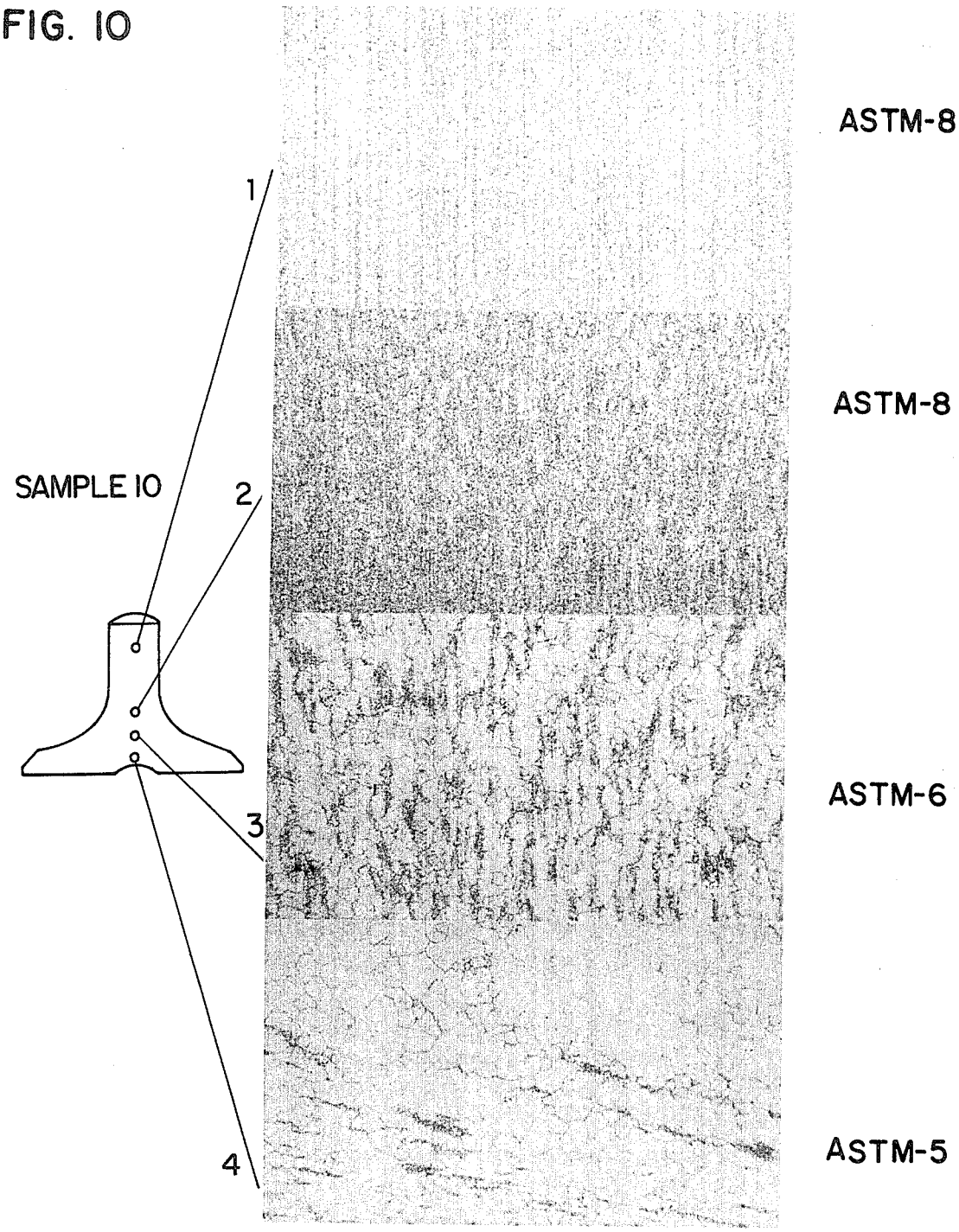
Figure 11:
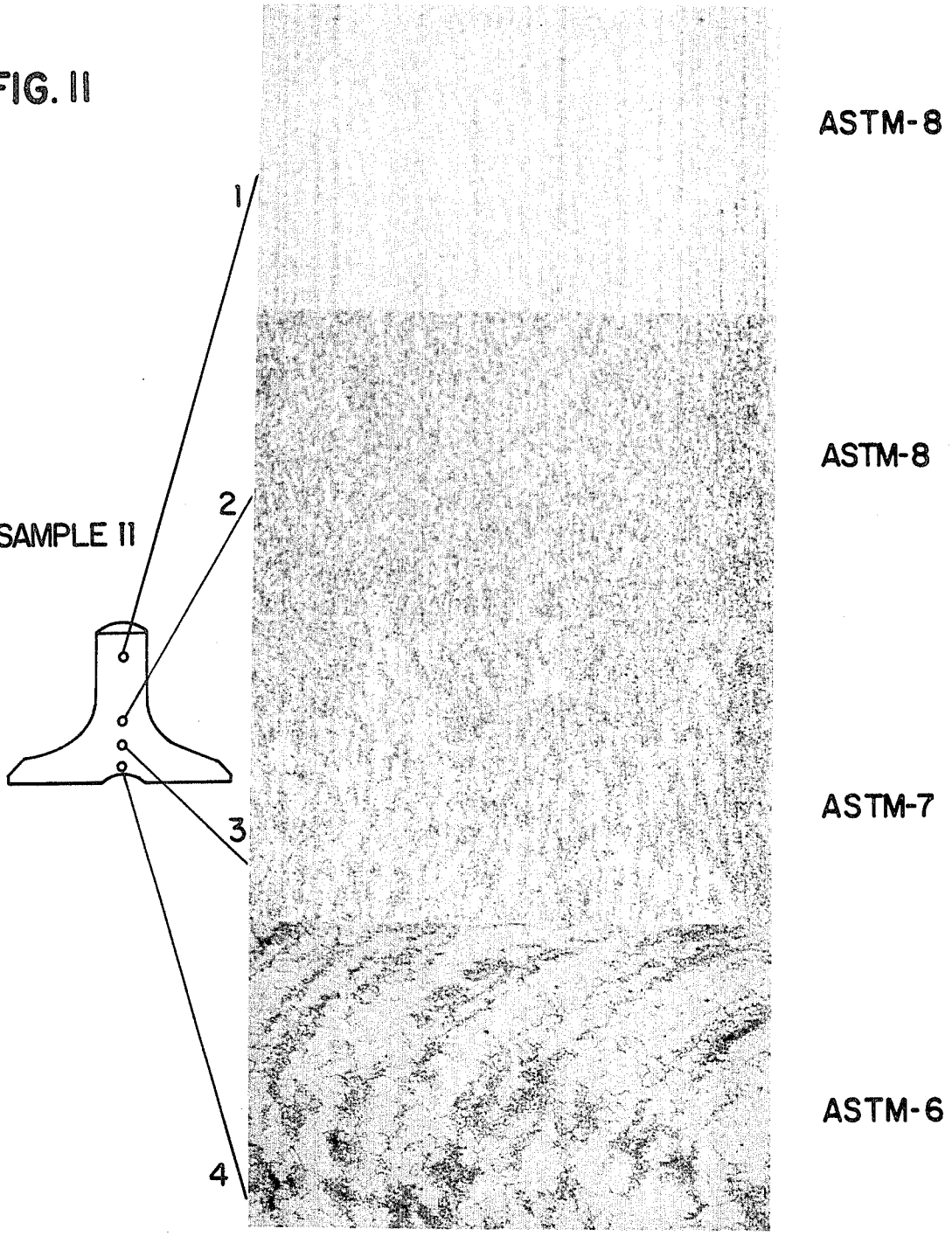
Figure 12:
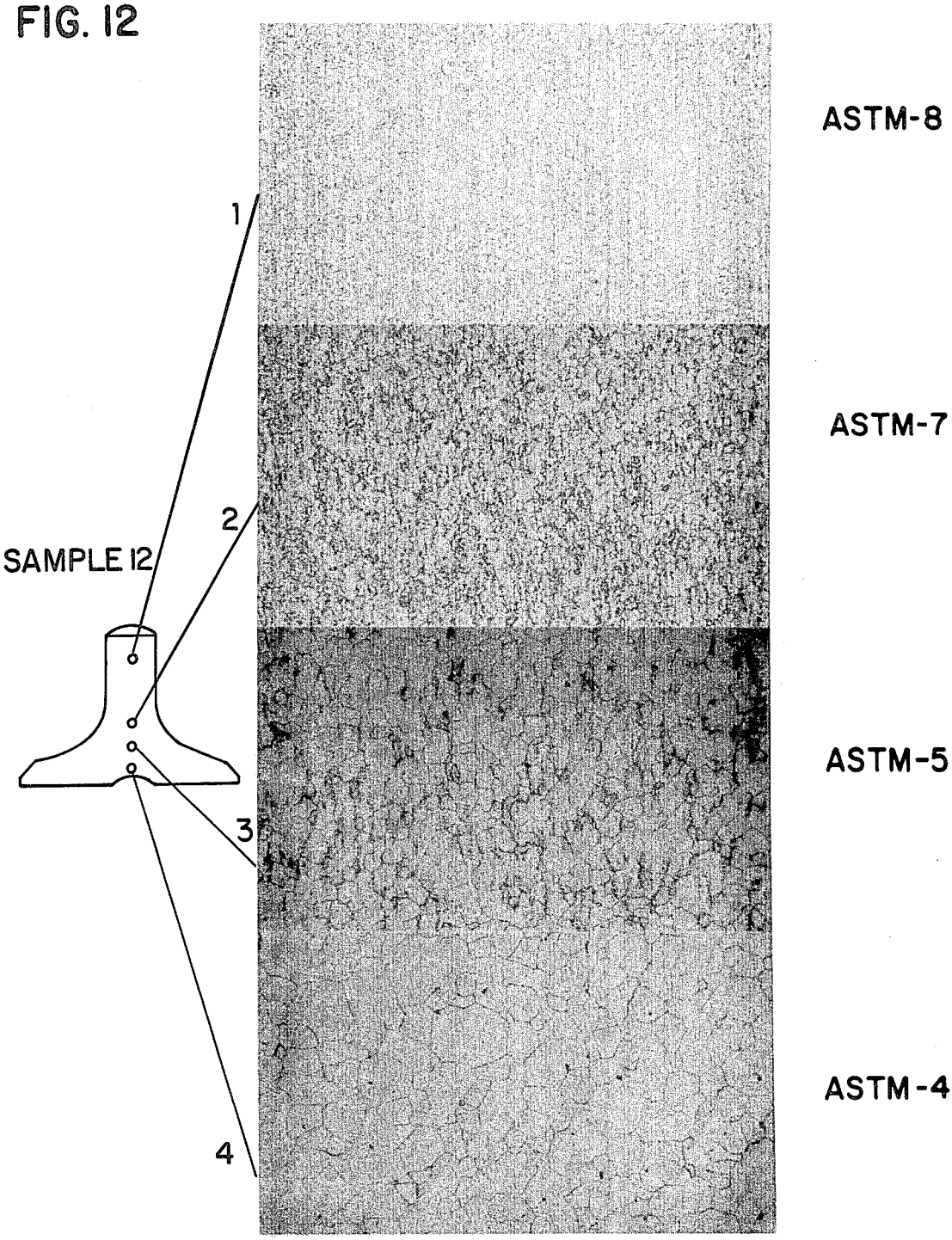
Figure 13:
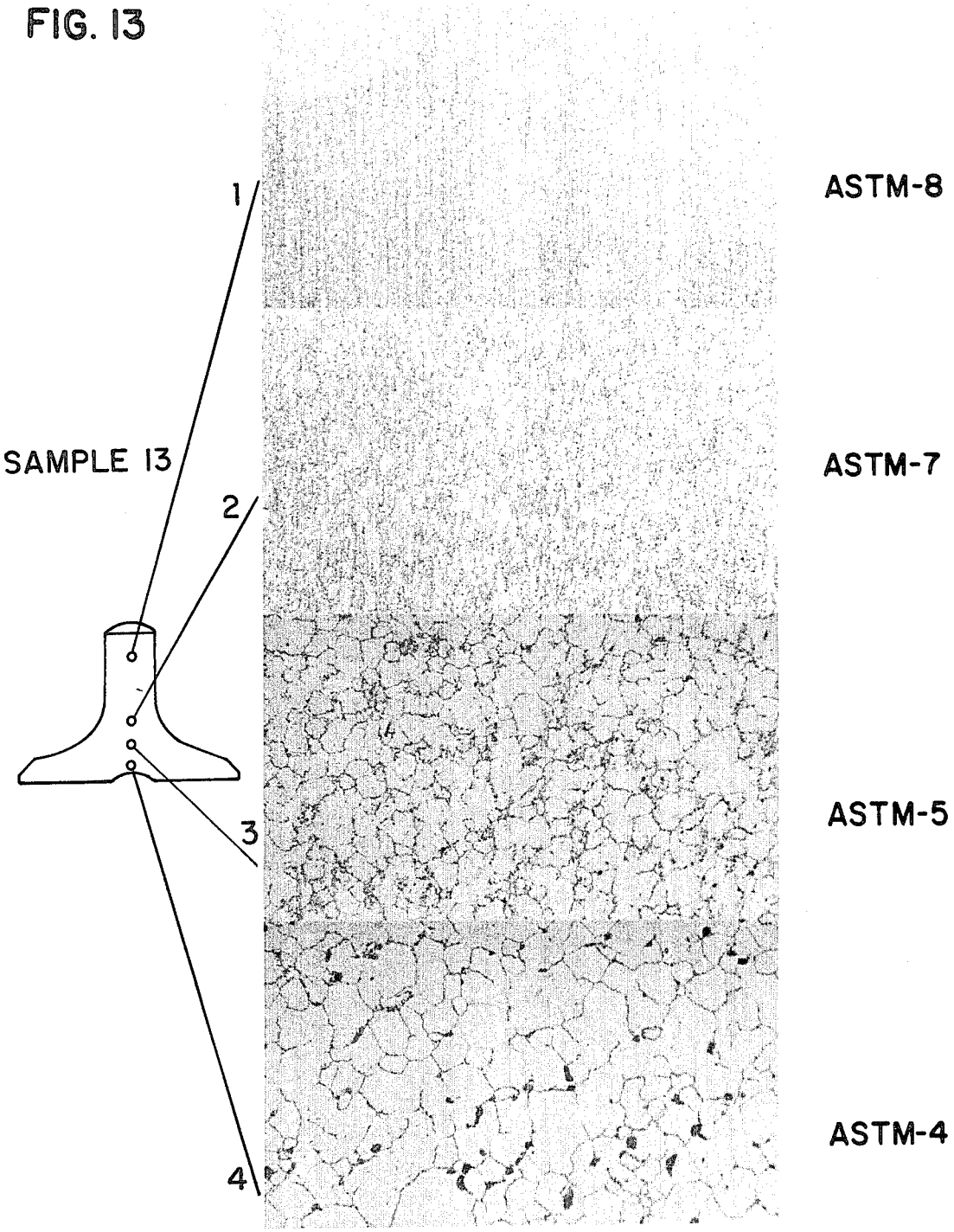
Figure 14:
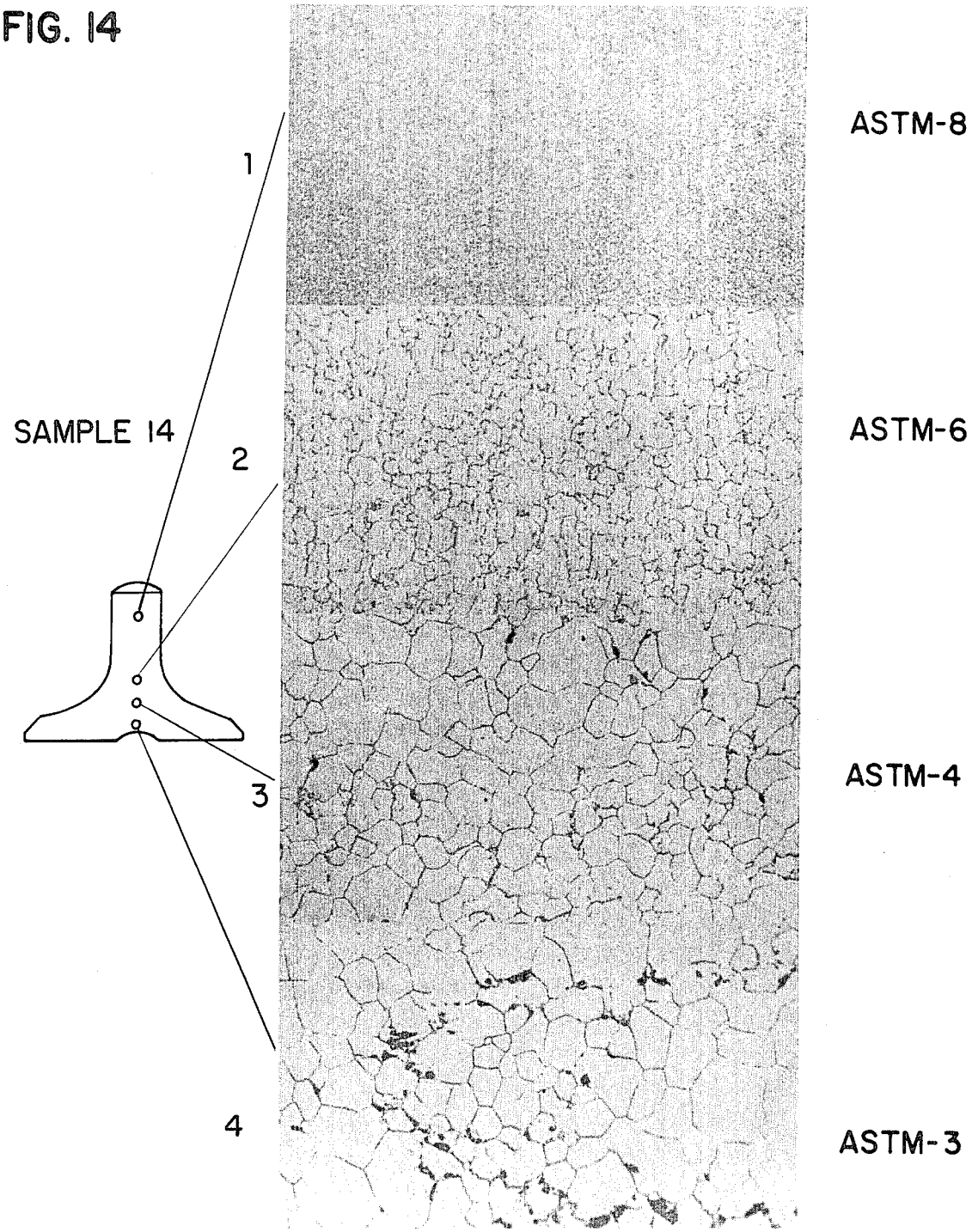

The process of the invention is applicable to the many commercially used valves and materials which are normally solution heat treated. As will be recognized by those familiar with the art of valve making, such materials include the austenitic steels of the S.A.E. EV series, and similar compositions. The invention is also applicable to solution heat treatable steels of the S.A.E. HEV, NV and VF series, nickel base alloys such as those sold under the trade designations Inconel, Waspalloy and Nimonic, Stellite, and similar compositions.

In the following specific examples which demonstrate the process and advantages of the invention, engine poppet valves forged from two different austenitic steels were solution heat treated in a radiant heating electric furnace described below. A first group of valves were made from an alloy steel similar to S.A.E. EV 12 having the composition set forth in Table I. Table II lists the furnace conditions, the time at temperature, and the ASTM grain size at various locations 0–3 through the valves. Position 0 is a cross-section through the valve at the combustion face, and the locations of positions 1–3 are indicated in FIGS. 1–5 which show the microstructures at these locations. It will be seen from Table II and FIGS. 1–5 that each of the solution treated valves has a microstructure characterized by a variable grain size which becomes progressively finer from the combustion faces (position 0) to the stems (position 3). The grain size varies from about ASTM 5 or larger at the combustion face to ASTM 8 or finer in the stems.

A second group of valves were forged from an austenitic steel having the composition set forth in Table III, and were solution heat treated in the same radiant heating electric furnace. The furnace conditions, and the speed of the belt or rotating hearth used to carry the valves through the furnace chamber are given in Table IV. Table IV also gives the hardnesses and ASTM grain sizes of selected valves at a four different cross-sectional locations through the valves. These locations are indicated in FIGS. 6–14 which also shows the valve microstructures at the four locations. As in the case of the first group of solution treated valves, it will be seen that the microstructure has a variable grain size ranging from about ASTM 5 or larger at the combustion face (position 4) to ASTM 8 or finer in the stems (position 1). The effect of the selective, rapid solution heat treatment is further demonstrated by the rapid drop in hardness from position 1 to position 4.

Figure 15:
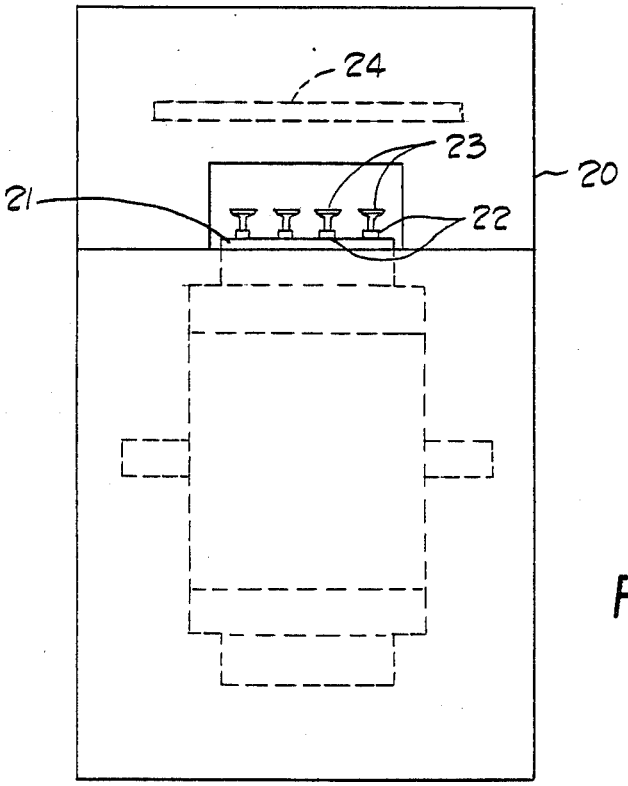
FIG. 15 is an elevational, diagrammatical view, partly in cross-section, of a radiant heating furnace useful for carrying out the process of the invention.

Referring now to FIG. 15, reference numeral 20 generally designates a radiant heating furnace suitable for carrying out the solution treating process described above in connection with the examples of the invention. The furnace 20 includes a rotating hearth in the form of a belt 21. As shown, the valves 23 are mounted in four positions across the width of the hearth or belt 21. The valves 23 are held upright in carrier tubes 22 so that the valve heads are transported below the globars 24 in the furnace chamber.

In use, the valves 23 are placed in the carrier tubes 22 so that the heads are exposed above the ends of the tubes. The amount that the heads are exposed is adjusted so that they will be solution treated to a selected depth from the combustion faces. The valves are then moved through the furnace chamber to rapidly heat the exposed heads and produce a grain size consistent with high temperature valve operating conditions, while maintaining a fine grain size in the stems within the carrier tubes.

Figure 16:
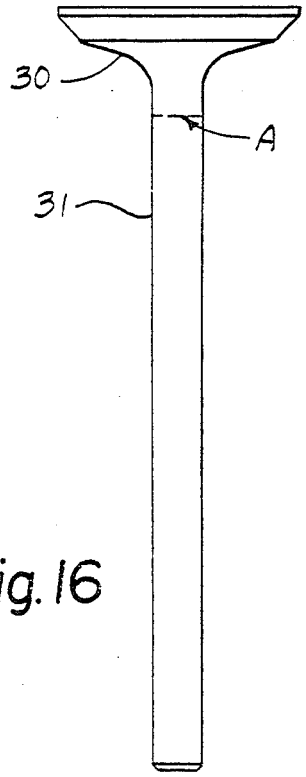
FIG. 16 is an elevational view of a spark-ignited engine valve solution treated in accordance with the invention.
Figure 17:
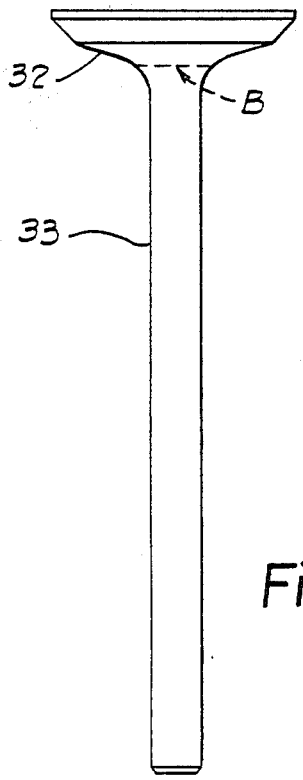
FIG. 17 is an elevational view of a compression-ignited engine valve solution treated in accordance with the invention.

The process of the invention as described in connection with FIG. 15 wherein the valve heads can be solution treated to a desired depth makes it possible to selectively solution treat spark-ignited and compression ignition engine valves in a manner best suited to their particular operating environments. FIG. 16 shows a spark-ignited valve which has been solution treated to produce a specific transition zone A between the fine grain size of the stem 31 and coarser grain size of the head 30 located deep in the stem-fillet blend. Preferably, the grain size in the head 30 is coarse, e.g. ASTM 3 or larger. FIG. 17 illustrates a compression ignition engine valve which has been solution treated so that the transition zone B between the fine grain of the stem 33 and the coarser grain of the head 32 is located closer to the combustion face. The combustion ignition engine valve will typically have an intermediate to coarse grain size in the head 32 ranging from about ASTM 3 to 5. As explained above, the locations of the transition zones A and B and the coarseness of the grain size in the valve heads can be effectively altered simply by changing the amount that the valve heads protrude above their carrier tubes in the radiant heating furnace.

Many modifications and variations of the invention will be apparent to those skilled in the art in light of the foregoing disclosure. Therefore, it is to be understood that, within the scope of the appended claims, the invention can be practiced otherwise than as specifically shown as described.

TABLE I

| | |
|---|---|
| C | .59 |
| Mn | 7.70 |
| P | .032 |
| S | .003 |
| Si | .25 |
| Cr | 19.71 |
| Ni | 1.73 |
| N | .36 |
| Fe | Bal. |

TABLE II

| VALVE ID NUMBER | FURNACE TEMP °F. | TIME TEMP (MIN.) | SOLUTION TREATMENT PROPERTIES ASTM GRAIN SIZE POS. 0 | POS. 1 | POS. 2 | POS. 3 |
|---|---|---|---|---|---|---|
| 1 | 2250 | 5 | 2-3 | 3-4 | 5-6 | 8-10 |
| 2 | 2250 | 9 | 2 | 3-5 | 5-6 | 9-10 |

TABLE II-continued

| VALVE ID NUMBER | FURNACE TEMP °F. | TIME TEMP (MIN.) | SOLUTION TREATMENT PROPERTIES ASTM GRAIN SIZE POS. 0 | POS. 1 | POS. 2 | POS. 3 |
|---|---|---|---|---|---|---|
| 3 | 2300 | 5 | 2-3 | 3-4 | 4-5 | 9-10 |
| 4 | 2300 | 2 | 4-5 | 3-5 | 5-6 | 9-10 |
| 5 | 2200 | 5 | 3 | 5-6 | 5-8 | 10 |

TABLE III

| | |
|---|---|
| C | .34 |
| Mn | 3.14 |
| P | .028 |
| S | .008 |
| Si | .76 |
| Cr | 22.07 |
| Ni | 7.62 |
| N | .28 |
| Fe | Bal. |

TABLE IV

| SAMPLE NO. | FURNACE TEMP. °F. | TIME AT TEMP. °F. | BELT SPEED | HARDNESS R/C POS. NO. 1 | 2 | 3 | 4 | A.S.T.M. GRAIN SIZE POS. NO. 1 | 2 | 3 | 4 |
|---|---|---|---|---|---|---|---|---|---|---|---|
| 6 | 2360 | 2 Min. | 6"/Min. | 36 | 24 | 21 | 21 | 8 | 5 | 4 | 3 |
| 7 | 2360 | 2.5 Min. | 6"/Min. | 29 | 24 | 21 | 21 | 8 | 5 | 4 | 3 |
| 8 | 2300 | 2 Min. | 6"/Min. | 33 | 31 | 25 | 21 | 8 | 8 | 6 | 5 |
| 9 | 2300 | 4 Min. | 3"/Min. | 33 | 27 | 21 | 21 | 8 | 7 | 3 | 2 |
| 10 | 2250 | 2 Min. | 6"/Min. | 33 | 32 | 27 | 22 | 8 | 8 | 6 | 5 |
| 11 | 2250 | 2 Min. | 6"/Min. | 35 | 34 | 30 | 25 | 8 | 8 | 7 | 6 |
| 12 | 2250 | 4 Min. | 3"/Min. | 32 | 30 | 25 | 20 | 8 | 7 | 5 | 4 |
| 13 | 2250 | 4 Min. | 3"/Min. | 35 | 31 | 24 | 22 | 8 | 7 | 5 | 4 |
| 14 | 2250 | 8 Min. | 1.5"/Min. | 31 | 25 | 21 | 20 | 8 | 6 | 4 | 3 |

We claim:

1. A solution heat treated poppet valve of the type including a stem and a head having a combustion face, said valve being heat treated to a controlled depth from its combustion face and having a microstructure characterized by a coarse grain size at the combustion face that is suitable for high temperature valve operating conditions and becomes progressively finer through a specific transition zone in the head to a fine size in the stem consistent with good low temperature properties, the grain size at the combustion face being in a range of from about ASTM 2 to 5 and the grain size in the stem being about ASTM 8 or finer.

* * * * *